United States Patent [19]

Tatem

[11] 4,443,659

[45] Apr. 17, 1984

[54] GLAZE TO PIN CONNECTION FOR AN ELECTRICAL INSULATOR WITH EMBEDDED METAL FITTING

[75] Inventor: William A. Tatem, Avon, N.Y.

[73] Assignee: Interpace Corporation, Parsippany, N.J.

[21] Appl. No.: 404,620

[22] Filed: Aug. 2, 1982

Related U.S. Application Data

[63] Continuation-in-part of Ser. No. 234,881, Feb. 17, 1981, abandoned.

[51] Int. Cl.[3] ..... H01B 17/42; H01B 17/50; H01B 17/08

[52] U.S. Cl. ..... 174/140 C; 174/182; 174/211

[58] Field of Search ..... 174/140 C, 141 C, 182, 174/189, 196, 211

[56] References Cited

U.S. PATENT DOCUMENTS

| | | | |
|---|---|---|---|
| 3,903,349 | 9/1975 | Thorpe et al. | 174/240 C |
| 3,941,918 | 3/1976 | Nigol et al. | 174/140 C |

FOREIGN PATENT DOCUMENTS

| | | | |
|---|---|---|---|
| 209031 | 7/1957 | Australia | 174/211 |
| 1512583 | 1/1968 | France | 174/182 |
| 586065 | 3/1947 | United Kingdom | 174/140 C |

OTHER PUBLICATIONS

*The Condensed Chemical Dictionary,* Sixth Edition, Reinhold Publishing Corp., New York, copyright 1961, pp. 217 and 876.

*Primary Examiner*—Laramie E. Askin
*Attorney, Agent, or Firm*—Charles E. Baxley

[57] ABSTRACT

This disclosure teaches an electrical insulator with improved glaze to pin electrical connection. A suitably contoured porcelain insulator shell is coated with a semiconductive glaze and has a metal cap and a metal pin each situated at a surface of the insulator shell opposite to the other. The insulator shell forms a recess to receive the pin and Portland cement is poured therein for mechanically securing the pin embedded in the insulator shell. A phenolic polymer composition is applied to cover the surface of the Portland cement to connect the pin electrically to the glaze and thus to accommodate passage of leakage current.

5 Claims, 1 Drawing Figure

GLAZE TO PIN CONNECTION FOR AN ELECTRICAL INSULATOR WITH EMBEDDED METAL FITTING

This invention is a continuation-in-part of U.S. patent application Ser. No. 234,881 filed Feb. 17, 1981, now abandoned.

BACKGROUND OF THE INVENTION

Electrical insulators commonly known as suspension insulators may be used individually, but usually form part of a string to support an electrical conductor from a supporting structure. Generally such a suspension insulator comprises two metal hardware members secured to opposite surfaces of a suitably contoured porcelain insulator shell, one hardware member being embedded by means of cement in a cavity in the porcelain insulator shell. An electrical insulator of this type is disclosed in U.S. Pat. No. 3,941,918. By this arrangement the metal hardware members are separated and insulated each from the other. The hardware members, typically an upper cap and a lower pin, each are secured to one of the opposite surfaces of the insulator shell usually by a layer of cement or other suitable material.

In order to improve performance of the electrical insulator, the insulator shell surface is coated presently with a semiconductive glaze. Upon energization of the porcelain or string of such insulators, the glaze coating carries a small current which reduces radio interference and corona susceptibility while simultaneously heating the shell surface, whereby the insulator shell performs better in various adverse environments. With the glaze coating, it is necessary to have electrical connection between the glaze coating and both metal hardware fittings. The electrical connection between the glaze and the metal hardware transfers leakage current from one insulator shell to the next.

One approach in the prior art for providing electrical connection between the glaze and the hardware has been to connect the pin to the insulator shell using Portland cement which has a conducting additive therein so as to make the cement electrically conductive. Said U.S. Pat. No. 3,941,918 proposed one type of conductive cement useful for this purpose; other conductive cements have been proposed in U.S. Pat. No. 3,903,349 and in United Kingdom Pat. Nos. 1,363,428; 1,363,429 and 1,398,306. These conductive cements, however, have not been without problems. Addition of conductive materials to Portland cement can reduce the strength of the cement. Passage of current through the conductive cement, which always contains some moisture, can produce electrochemical reactions, especially at a cap or a pin when it has a positive polarity. Such reactions may be a accompanied by volumetric expansions, resulting in cracking or expansive rupturing of the porcelain insulator shell, thereby rendering the insulator nonfunctional and useless electrically. In practice the more severe problems occur at the pin, because at the pin the expansion forces generated by the conductive cement result in a tensile stress in the porcelain which the porcelain is less suited to withstand. Conversely the expansion forces generated by the cement at the cap compress the porcelain and the porcelain is particularly resistant to such compression.

U.S. Pat. No. 3,903,349 discusses the prior art attempts at overcoming the disadvantages of using Portland cement. For example, it is known to bond and epoxide resin layer containing aluminum powder to the metal components and glazed surface layer to cover and seal the Portland cement. However, the reference clearly indicates that resistance to weathering is unsatisfactory.

It has been attempted also to install metallic conductors between the metal hardware and the semiconductive glaze coating of the porcelain insulator shell and this approach is discussed in U.S. Pat. No. 2,239,809. Such metallic conductors carry the current from metal to glaze, without passing it through the cement so consequent volumetric expansion in the cement is avoided. But these metallic connectors have been found to create additional unwanted effects and, therefore, they are unsatisfactory. Initially these metallic conductors performed well; however in a relatively short time, severe corrosion and/or erosion of the glaze was experienced at the narrow band of interface between the glaze and the metal connector. Such corrosion and/or erosion resulted in rapid loss of glaze conductivity and continuity with consequent loss of benefit of the semiconductive glaze coating, plus other problems such as electrical discharges at the damaged glaze area and localized heat shock to the porcelain.

STATEMENT OF INVENTION

The foregoing difficulties of prior art electrical insulators are solved in a particularly novel, useful and unobvious way by the teaching of the present invention. According to the present invention, Portland cement (with no conductive additives therein), preferably neat Portland cement, is positioned in the pin recess formed by the porcelain insulator shell about the pin, thus securing the pin to the insulator shell for mechanical integrity. Then a phenolic polymer composition, containing a phenolic resin and having a nonionic electrical conductivity substantially greater than the conductivity of Portland cement is applied to connect the metal pin electrically to the semiconductive glaze coating in a manner which substantially prohibits air from contacting the Portland cement. The recess forms a mouth and the phenolic polymer composition preferably covers that entire mouth.

The phenolic polymer composition used in the present invention has reasonably high nonionic electrical conductivity; is resistant to the effects of weather; bonds well to glaze, cement and metal surfaces; and is relatively inexpensive and appliable conveniently in a factory. One preferred material is a conductive carbon filled phenolic resin manufactured and sold under the trademark CARBO-KOREZ by Atlas Minerals and Chemicals Company.

Therefore, a primary object of this invention is to provide a cementing arrangement, including Portland cement sealed by a phenolic resin composition, for use with electrical insulators having a semiconductive glaze coating on their porcelain insulator shells, to enable electrical connection of the glaze to hardware, without passage of significant leakage currents through the Portland cement.

It is a further object of this invention to provide a cement arrangement which has low shrinkage, so that stable bonds are maintained between metal hardware and insulator surfaces.

It is still a further object of this invention to provide electrical insulators of the type here contemplated in which semiconductive glazes on the porcelain insulator shells are enabled to function effectively by carrying a small current.

It is still a further object of this invention to provide electrical insulators of the type here contemplated which have mechanical integrity during long service lives, and which experience no or very little water absorption.

It is still a further object of this invention to provide electrical insulators of the type here contemplated which are well suited otherwise to perform their intended functions. The foregoing objects as well as other objects, features and advantages of this invention will be understood more fully from an accompanying drawing, from a detailed description of a preferred embodiment and from claims which are presented herewith.

The drawing and embodiment shown therein are for illustrative purposes only and are not meant to limit or redefine the invention as disclosed and claimed herein.

DESCRIPTION OF THE PREFERRED EMBODIMENT

Figure 1:
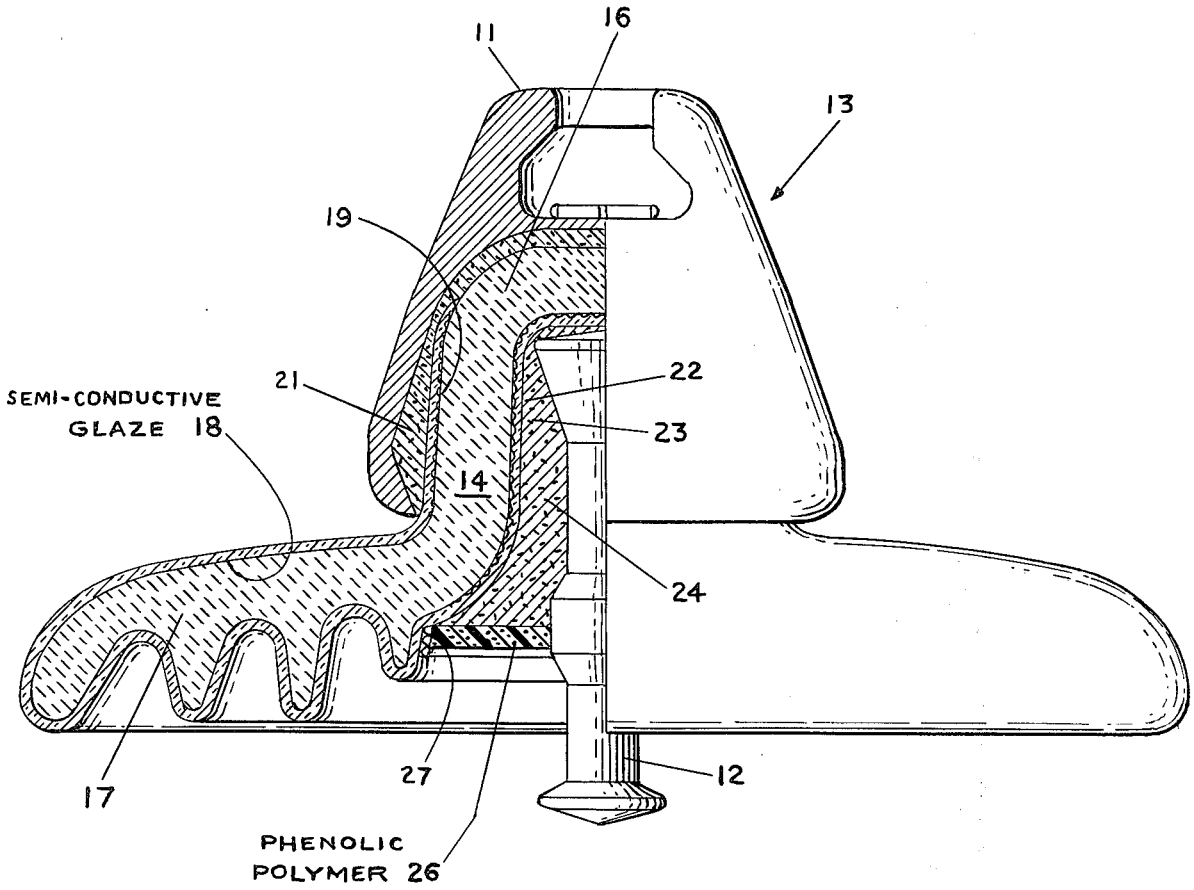
FIG. 1, the only FIGURE, is a front view of a preferred embodiment of an electrical insulator according to the present invention, the left half of the FIGURE is shown in cross section.

Referring to the FIGURE, a typical cap 11 and pin 12 type electrical insulator according to the present invention is designated generally 13; however, it should be understood that the specific form of the insulator 13 is not profound so long as features essential to the invention are found therein. When assembled in a string, cap 11 is attached to a pin of an electrical insulator above it and the pin 12 is connected to a cap of an electrical insulator below it. A contoured porcelain insulator shell 14 is composed of a head 16 and a shed 17 and is coated on its exposed and sand band surfaces 19, 22 with a semiconductive glaze 18 described, for example, in U.S. Pat. No. 3,658,583. The cap 11 is metal and is fixed to the sanded surface 19 of the insulator shell 14 at the outer periphery of the head 16 by capping means in the form of cement 21. The pin 12 is metal and is fixed to the sanded surface 22 of the insulator shell 14 (in a pin recess 23 formed in the head 16) by means of cement 24.

Both cement 21 and cement 24 preferably are neat Portland cement for securing mechanically the cap 11 and the pin 12 respectively to the insulator shell 14. The electrical connection of the glaze 18 to the pin 12 is achieved by use of a phenolic polymer composition 26 such as, for example, CARBO-KOREZ preferably placed in a mouth 27 formed in the pin recess 23. It is desirable to have the phenolic polymer composition cover the entire mouth 27. By this arrangement leakage current flow between the glaze 18 and the pin 12 is shunted around the cement 24. The leakage current is carried by the phenolic polymer composition 26 which is not affected adversely by the passage of the leakage current therethrough.

Various phenolic polymers will perform satisfactorily in this service, including phenolic polymers filled with (for example) carbon particles. As has been mentioned above, an effective low cost commercial product suitable to serve as the phenolic polymer composition is available under the trademark CARBO-KOREZ corrosion proof cement sold by Atlas Minerals and Chemicals Company. The CARBO-KOREZ cement has a resistivity of about 10,000 ohm centimeters, intermediate between that of the semiconductive glaze and the metal of the pin and cap.

It has also been found that especially efficient electrical conduction is obtained between the glaze and the cap through Portland cement without addition of conductive materials because of the large volume of cement therein relative to that in the pinhole. Accordingly, a conductive organic is not needed between the glaze and the cap. Additionally, any electrochemical reactions creating volumetric expansions in the cap materials produce only compressive loads on the porcelain, which said porcelain is well suited to withstand.

Long term tests have shown electrical insulators according to the present invention perform extremely well without undesirable effects of those using metallic conductors or conductive Portland cements with or without an epoxide resin layer. The units were energized with direct current for up to several years with periodic inspections carried out to observe changes and to measure conductivities. It has been observed that the direct current provides an acceleration of the undesirable porcelain cracking phenomenon experienced with alternating current over a longer period of time.

A first series of four experiments were run in which semiconducting glaze insulators using conductive Portland cement in the conventional fashion were energized over a period of time. In the first experiment of this series a group of four units was energized with DC with the pin negative to the cap for fifteen months, during which no cracking of porcelain occurred. The polarity was then reversed, making the pin positive to the cap. After 2.5 months, three of the four porcelains had cracked.

In the second experiment of this series, twelve insulators similar to those in the first experiment were energized with the polarity of the pin positive relative to the cap. After 3 months of energization, one of the twelve porcelains had cracked and by 8.5 months an additional seven had cracked.

In the third experiment of this series, similar to the second, three of four energized porcelains cracked within 6.5 months.

In the fourth experiment of this series, similar to the second, one of four energized porcelains cracked within twelve months.

From the foregoing, it can be seen that the preponderance of cracking of porcelains in semiconducting glaze suspensions assembled in the conventional way is unreasonably high, with significant cracking occurring in a period of time of about two and one-half to about twelve months. The variation in time for a given percentage of units to crack is dependent upon a number of factors which vary in outdoor exposure, particularly the level of humidity present in the surrounding air during the exposure.

However, the above experiments involving visually obvious cracking do not entirely reveal the physical condition of the apparently intact units. When manufactured, suspension units of the type tested have mechanical-electrical strengths well above their rated strength, usually averaging about 120% or more of rating. The apparently intact units assembled by the conventional way in the first series of experiments above were subsequently tested for their ultimate mechanical-electrical strength after the energization period. Of eight units tested in this fashion, the following percentages of rated strength were found: 74, 76, 84, 86, 103, 121, 123, 123. As can be seen, many of the apparently intact units were in fact weakened and might eventually be expected to crack.

To demonstrate the improvement possible by the new method described in the present invention, a second series of two experiments was conducted. In the first experiment of this series, four units were energized for nineteen months with DC so that the pin was negative relative to the cap. None of the units cracked. The polarity was then reversed for 4.5 months and again no cracking occurred.

In the second experiment of this series, four units were energized for 4.5 months with DC so that the pin was negative relative to the cap. Again no units cracked. The polarity was then reversed for nineteen months, during which no units cracked.

From these two experiments of the second series it can be seen that regardless of polarity, in periods up to nineteen months, no visible cracking occurred. These results are in strong contrast to those obtained in the preceding series of experiments.

Of the four units made by the procedure of the present invention and tested in the second experiment of the second series, the mechanical-electrical strengths were found to be the following percentage of rated strength: 126, 141, 146, 154. As can be seen, these intact units all had strengths well above rating and similar to what typically can be found for suspension units using standard nonconductive glaze after similar periods of field exposure.

It will be evident to those skilled in design, manufacture, installation and maintenance of electrical insulators that various deviations may be made from the shown and described preferred embodiment, without departing from a main theme of invention set forth in the following claims.

I claim:

1. In an electrical insulator comprising in combination:

a suitably contoured porcelain shell with a semiconductive glaze;

a metal cap and a metal pin each situated at a surface of the insulator shell opposite to the other, the insulator shell forming a pin recess receiving the pin;

capping means securing mechanically the cap to the shell; and

Portland cement in the recess and about the pin securing mechanically to the shell the pin embedded in the recess;

the improvement comprising a phenolic polymer composition having long term weather resistance and being connected between the pin and the glaze and substantially sealing the Portland cement from contact with moisture in the air, the phenolic polymer composition having a nonionic electrical conductivity substantially greater than the conductivity of the Portland cement.

2. The electrical insulator according to claim 1 further comprising:

the pin recess forming a mouth;

the phenolic polymer composition completely covering the mouth;

the phenolic polymer composition being resistant to weathering and having good bonding to the glaze, to the Portland cement and to the metal pin.

3. The electrical insulator according to claim 2 wherein the capping means constitutes neat Portland cement.

4. The electrical insulator according to claim 1 wherein the Portland cement in the pin recess is neat Portland cement.

5. In an electrical insulator comprising in combination:

a suitably contoured porcelain shell with a semiconductive glaze;

a metal cap and a metal pin each situated at a surface of the porcelain shell opposite to the other, the insulator shell forming a pin recess receiving the pin;

capping means securing mechanically the cap to the shell; and

Portland cement in the recess and about the pin securing mechanically to the shell the pin embedded in the recess; wherein the improvement comprises a conductive carbon-filled phenolic polymer composition which bonds to the cement and to the glaze on the porcelain shell and to the pin, the composition having long-term weather resistance and forming an electrical connection between the pin and the glaze and substantially sealing the Portland cement from contact with moisture in the air, the phenolic polymer composition having a nonionic electrical conductivity substantially greater than the conductivity of the Portland cement.

* * * * *

UNITED STATES PATENT AND TRADEMARK OFFICE

CERTIFICATE OF CORRECTION

PATENT NO. : 4,443,659

DATED : April 17, 1984

INVENTOR(S) : William A. Tatem

It is certified that error appears in the above-identified patent and that said Letters Patent are hereby corrected as shown below:

Column 1, line 29, the word "porcelain" should read --insulator--;

Column 6, line 31, (Claim 5, line 7) the word "insulator" should read --porcelain--.

Signed and Sealed this

*Sixteenth* Day of *October 1984*

[SEAL]

*Attest:*

GERALD J. MOSSINGHOFF

*Attesting Officer*

*Commissioner of Patents and Trademarks*